US007559997B2

(12) United States Patent
Nakajima et al.

(10) Patent No.: US 7,559,997 B2
(45) Date of Patent: Jul. 14, 2009

(54) HIGH-STRENGTH COLD ROLLED STEEL SHEET AND PROCESS FOR PRODUCING THE SAME

(75) Inventors: Katsumi Nakajima, Hiroshima (JP); Takayuki Futatsuka, Hiroshima (JP); Yasunobu Nagataki, Hiroshima (JP)

(73) Assignee: JFE Steel Corporation, Tokyo (JP)

( * ) Notice: Subject to any disclaimer, the term of this patent is extended or adjusted under 35 U.S.C. 154(b) by 392 days.

(21) Appl. No.: 10/496,433

(22) PCT Filed: Jun. 23, 2003

(86) PCT No.: PCT/JP03/07939

§ 371 (c)(1),
(2), (4) Date: May 20, 2004

(87) PCT Pub. No.: WO04/001084

PCT Pub. Date: Dec. 31, 2003

(65) Prior Publication Data

US 2004/0261919 A1 Dec. 30, 2004

(30) Foreign Application Priority Data

Jun. 25, 2002 (JP) ..... 2002-185093

(51) Int. Cl.

| | |
|---|---|
| ***C22C 38/04*** | (2006.01) |
| ***C22C 38/06*** | (2006.01) |
| ***C21D 8/00*** | (2006.01) |
| ***C21D 8/04*** | (2006.01) |

(52) U.S. Cl. ..... 148/320; 148/333; 148/334; 148/330; 148/603; 148/651

(58) Field of Classification Search ..... 148/320, 148/603, 333–334, 661–662, 651–652, 330
See application file for complete search history.

(56) References Cited

U.S. PATENT DOCUMENTS 5,074,926 A 12/1991 Tosaka et al.

(Continued)

FOREIGN PATENT DOCUMENTS

EP 0 432 498 A2 6/1991

(Continued)

OTHER PUBLICATIONS

Patent Abstracts of Japan, vol. 2000, No. 03, Mar. 30, 2000, of JP 11 343538 A (Kawasaki Steel Corp), Dec. 14, 1999.

(Continued)

*Primary Examiner*—Deborah Yee
(74) *Attorney, Agent, or Firm*—Frishauf, Holtz, Goodman & Chick, P.C.

(57) ABSTRACT

The invention provides a high strength cold rolled steel sheet comprising ferrite phases and second phases, in which the mean grain size of the ferrite phases is 20 μm or less, the volume fraction of the second phase is 0.1% or more to less than 10%, the absolute value |Δr| of in-plane anisotropy of r value is less than 0.15, and the thickness is 0.4 mm or more. The high strength cold rolled steel sheet of the present invention has a tensile strength of 370 to 590 MPa, and has excellent stretchability, dent resistance, surface precision, secondary working embrittlement, anti-aging, and surface appearance, therefore it is suitable for outer panels of automobile.

18 Claims, 8 Drawing Sheets

U.S. PATENT DOCUMENTS

| | | | | |
|---|---|---|---|---|
| 5,486,241 | A | 1/1996 | Ushioda et al. | |
| 6,306,527 | B1 | 10/2001 | Ikeda et al. | |
| 6,702,904 | B2 | 3/2004 | Kami et al. | |
| 6,899,771 | B2 | 5/2005 | Kami et al. | |
| 6,902,630 | B2 | 6/2005 | Kami et al. | |
| 7,101,445 | B2 * | 9/2006 | Kami et al. | 148/320 |
| 2003/0047256 | A1 | 3/2003 | Kami et al. | |

FOREIGN PATENT DOCUMENTS

| | | | |
|---|---|---|---|
| EP | 0 612 857 | A1 | 8/1994 |
| EP | 1 193 322 | A1 | 4/2002 |
| JP | 2-18363 | B2 | 4/1990 |
| JP | 5-78784 | A | 3/1993 |
| JP | 8-176735 | A | 7/1996 |
| JP | 11-343538 | A | 12/1999 |
| JP | 2000-239786 | A | 9/2000 |
| JP | 2001-73077 | A | 3/2001 |
| JP | 2001-207237 | A | 7/2001 |
| JP | 2002-146478 | * | 5/2002 |
| JP | 2002-322537 | A | 11/2002 |
| WO | WO 01/90431 | A1 | 11/2001 |

OTHER PUBLICATIONS

Patent Abstracts of Japan, vol. 2000, No. 12, Jan. 3, 2001, of JP 2000 239786 A (Kawasaki Steel Corp), Sep. 5, 2000.

* cited by examiner

| | COOLING CONDITIONS AFTER HOT ROLLING | ANNEALING |
|---|---|---|
| ■ | METHOD OF INVENTION | α + γ REGION |
| ▲ | METHOD OF INVENTION | α REGION |
| □ | CONVENTIONAL METHOD | α + γ REGION |

HIGH-STRENGTH COLD ROLLED STEEL SHEET AND PROCESS FOR PRODUCING THE SAME

This application is the United States national phase application of International Application PCT/JP03/07939 filed Jun. 23, 2003.

TECHNICAL FIELD

The present invention relates to a high strength cold rolled steel sheet suitable for inner and outer panels of automobile, and particularly relates to a high strength cold rolled steel sheet having excellent stretchability and a tensile strength of 370 to 590 MPa and a method for manufacturing the same.

BACKGROUND ART

Recently, weight saving in a steel sheet for automobile has been promoted in view of environmental issue, and use of a cold rolled steel sheet having improved strength has been investigated for inner and outer panels of automobile. The cold rolled steel sheet for inner and outer panels of automobile is required to have excellent stretchability, dent resistance, surface precision, anti-secondary working embrittlement, anti-aging, and surface appearance, and a high strength cold rolled steel sheet having such characteristics and a tensile strength of 370 to 590 MPa is now strongly desired by automobile manufacturers.

Before now, for example, JP-A-5-78784 proposes a high strength cold rolled steel sheet having a tensile strength of 350 to 500 MPa, which comprises a Ti-bearing ultra-low carbon steel added with a large amount of solid solution hardening elements such as Mn, Cr, Si, or P.

JP-A-2001-207237 or JP-A-2002-322537 proposes a galvanized steel sheet (dual phase structure steel sheet: DP steel sheet) having a tensile strength of less than 500 MPa, which comprises 0.010 to 0.06% C, 0.5% or less Si, not less than 0.5% to less than 2.0% Mn, 0.20% or less P, 0.01% or less S, 0.005 to 0.10% Al, 0.005% or less N, 1.0% or less Cr, wherein (Mn+1.3 Cr) is 1.9 to 2.3%, and consists of ferrite phases and second phases (low temperature transformation phases) of 20% or less by area ratio containing martensite phases of 50% or more.

However, the high strength cold rolled steel sheet described in JP-A-5-78784 has poor anti-aging, bad surface appearance due to a large amount of Si causing a problem in plating, and poor anti-secondary working embrittlement due to a large amount of P.

On the other hand, the DP steel sheet described in JP-A-2001-207237 or JP-A-2002-322537 does not have such problems since it is strengthened by second phases, however, it was found from the inventor's supplementary examination that the steel sheet did not always have sufficient stretchability and therefore it was not always applicable to outer panels of automobile.

DISCLOSURE OF THE INVENTION

The present invention aims to provide a high strength cold rolled steel sheet having a tensile strength of 370 to 590 MPa, which is applicable to outer panels of automobile such as door or hood produced mainly by stretch forming.

The object is achieved by a high strength cold rolled steel sheet comprising ferrite phases and second phases, wherein the mean grain size of the ferrite phases is 20 μm or less, the volume fraction of the second phases is not less than 0.1% to less than 10%, the absolute value of in-plane anisotropy of r value $|\Delta r|$ is less than 0.15, and the thickness is 0.4 mm or more.

The high strength cold rolled steel sheet, for example, consists essentially of, by mass %, less than 0.05% C., 2.0% or less Si, 0.6 to 3.0% Mn, 0.08% or less P, 0.03% or less S, 0.01 to 0.1% Al, 0.01% or less N, and the balance of Fe.

The high strength cold rolled steel sheet can be manufactured using a method comprising the steps of: cold rolling a hot rolled steel sheet having the above composition and containing second phases of 60% or more by volume fraction at a reduction rate of higher than 60% to lower than 85%, and continuously annealing the cold rolled steel sheet in an $\alpha+\gamma$ region.

EMBODIMENTS OF THE INVENTION

After investigation on a high strength cold rolled steel sheet having a tensile strength of 370 to 590 MPa suitable for outer panels of automobile, it becomes clear that a cold rolled steel sheet having excellent stretchability, dent resistance, surface precision, anti-secondary working embrittlement, anti-aging, and surface appearance can be obtained under the following conditions (1) and (2).

(1) Second phases comprising mainly martensite phases are dispersed uniformly in fine ferrite phases.

(2) Absolute value of in-plane anisotropy of r value $|\Delta r|$ is reduced.

Hereinafter, the detail will be discussed.

1. Microstructure

As described above, in a steel sheet comprising single ferrite phases, harmful elements to outer panels of automobile, such as Si or P, must be added much to strengthen, therefore the object of the present invention can not be achieved.

Thus, the steel sheet should be strengthened by forming dual phase structure comprising ferrite phases and second phases having mainly martensite phases. However, sufficient stretchability can not be obtained by this structure-strengthening. To obtain sufficient stretchability, the second phases comprising mainly martensite phases need to be dispersed uniformly in ferrite phases, which has a mean grain size of 20 μm or less, at a volume fraction of not less than 0.1% to less than 10%. Such second phases are precipitated at the grain boundaries of the ferrite phases.

When the mean grain size of ferrite phases exceeds 20 μm, orange peel is generated at press-forming, resulting in deterioration in surface appearance and deterioration in stretchability. Therefore, the mean grain size is made to be 20 μm or less, preferably 15 μm or less, and further preferably 12 μm or less.

When the volume fraction of second phases comprising mainly martensite phases is less than 0.1% or 10% or more, sufficient stretchability can not be obtained. Therefore, the volume fraction of second phases is made to be not less than 0.1% to less than 10%, and preferably not less than 0.5% to less than 8%. The second phases comprising mainly martensite phases may have retained γ phases, bainite phases, pearlite phases, and carbides other than martensite phases in a range of 40% or less, preferably 20% or less, and further preferably 10% or less to attain the object of the present invention.

Figure 1A:
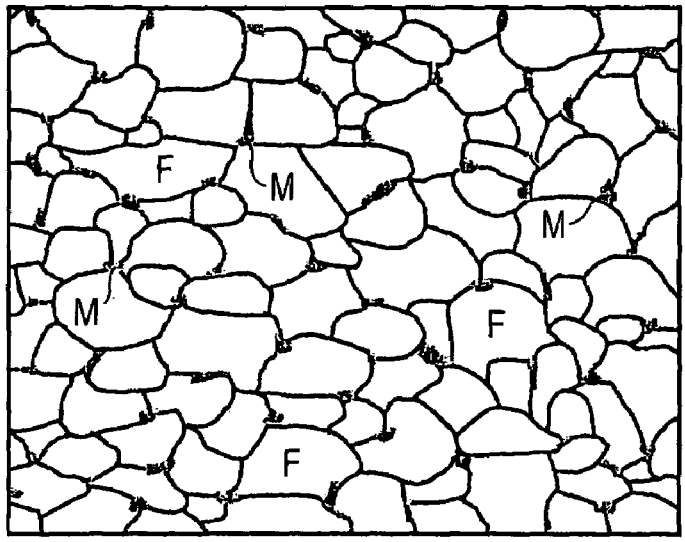
FIGS. 1A and 1B are schematic views showing microstructures of a high strength cold rolled steel sheet of the present invention and a conventional DP steel sheet respectively.
Figure 1B:
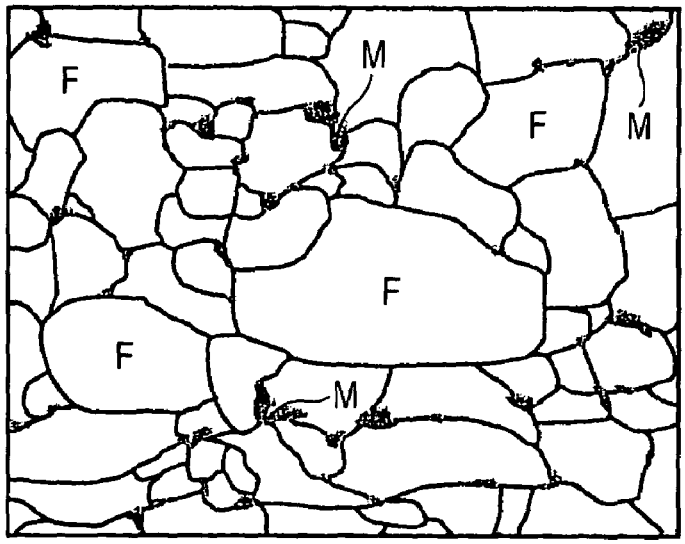

FIGS. 1A and 1B are views schematically showing microstructure of a high strength cold rolled steel sheet of the present invention and a conventional DP steel sheet respectively.

In the steel sheet of the present invention, fine second phases M are dispersed uniformly in uniform and fine ferrite phases F and along the grain boundaries of the ferrite phases F. On the other hand, in the conventional DP steel sheet, coarse second phases M are dispersed nonuniformly in nonuniform and coarse ferrite phases F and along the grain boundaries of the ferrite phases F.

Figure 2:
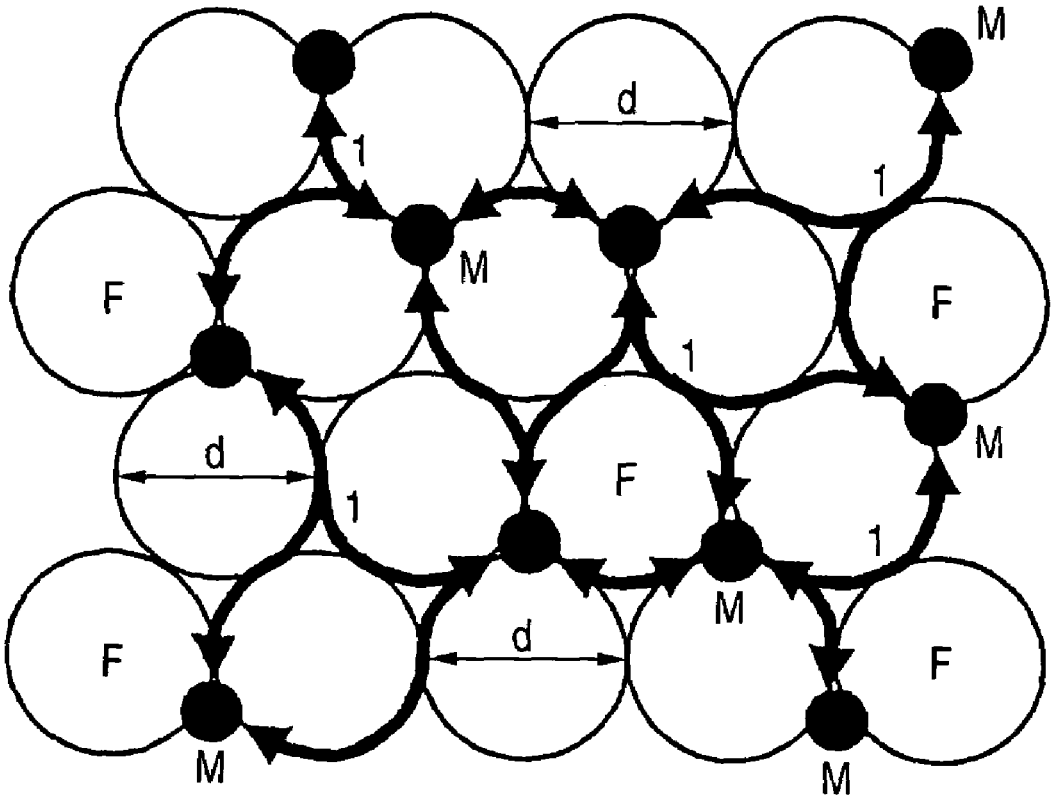
FIG. 2 is a view illustrating distance 1 among adjacent second phases M measured along grain boundaries of ferrite phases F.

Now, as shown in FIG. 2, when the mean grain size of the ferrite phases F is assumed to be d (μm), and the mean value of distance 1 among adjacent second phases M measured along the grain boundaries of the ferrite phases F is set to be L (μm), if the following formula (1) is satisfied, YPEl (yield point elongation) disappears easily, which is advantageous for reduction of YP (yield point), and makes it possible to further improve anti-aging.

$$L<3.5\times d \quad (1)$$

It is more advantageous to satisfy the formula L<3.1×d, and much more advantageous to satisfy the formula L<2.4×d.

2. |Δr|

In addition to the requirement for microstructure, it is extremely important for improvement of stretchability that the absolute value of in-plane anisotropy of r value |Δr| should be less than 0.15.

Such reduction of the absolute value of in-plane anisotropy of r value |Δr| implies that the steel sheet is made to be more isotropic (each r value at 0°, 45°, and 90° to a rolling direction, namely each of r0, r45, and r90 is equal to 1), and it is considered that the yield strength in a biaxial tension region is reduced thereby, therefore the stretchability is improved.

To further improve isotropy of the steel sheet, it is effective that difference between maximum value $r_{max}$ and minimum value $r_{min}$ of the r0, r45, and r90 is 0.25 or less, preferably 0.2 or less, and further preferably 0.15 or less. It is further effective that the r90 is 1.3 or less, preferably 1.25 or less, and further preferably 1.2 or less.

It is well known that r value is related to texture of steel sheet.

Figure 3:
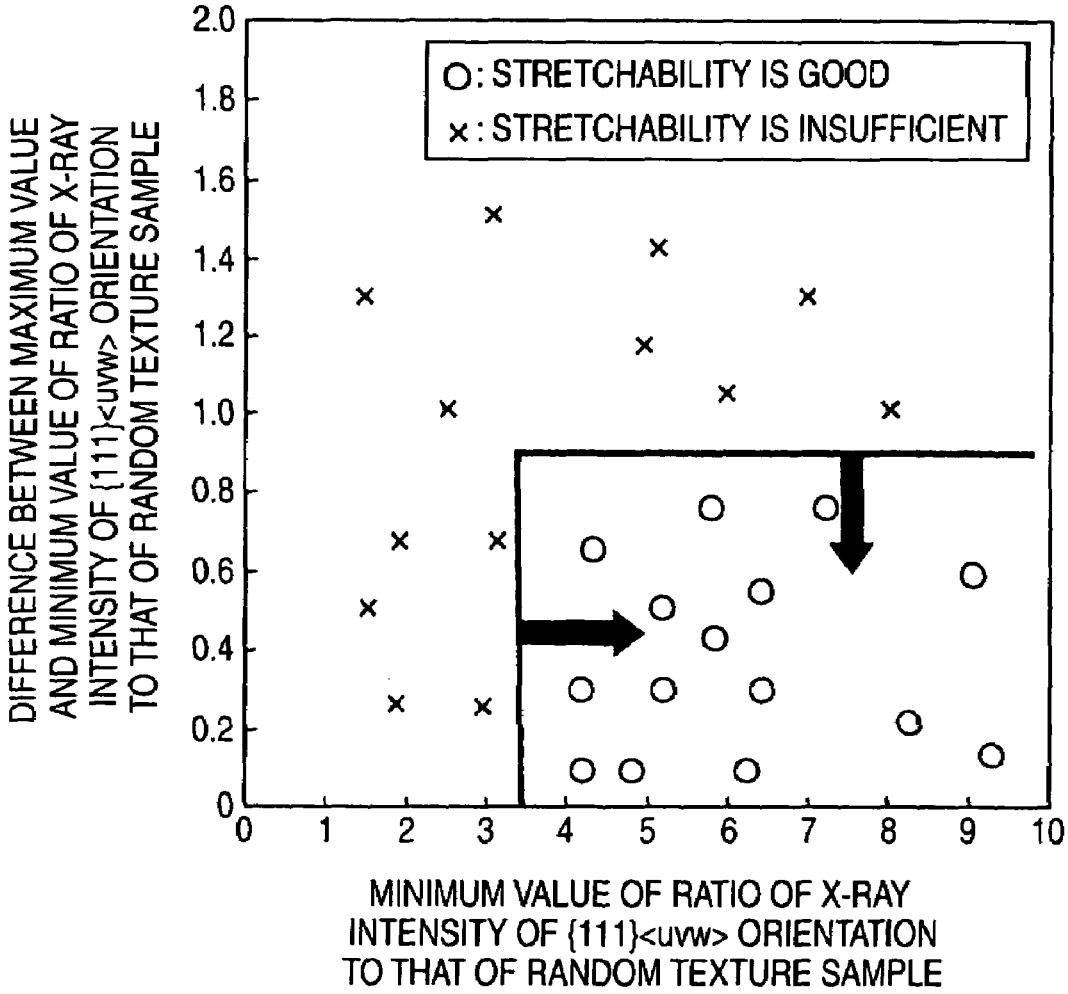
FIG. 3 is a relationship between texture and stretchability.

FIG. 3 shows a relationship between texture and stretchability, and it is confirmed that if the ratio of an X-ray intensity of {111}<uvw> orientation to that of random texture sample as abscissa is 3.5 or more, and the difference between maximum intensity ratio and minimum intensity ratio of the orientation as ordinate is 0.9 or less, or if the steel sheet is more isotropic, excellent stretchability can be obtained. Here, the ratio of the X-ray intensity of {111}<uvw> orientation to that of random texture sample and the difference between maximum intensity ratio and minimum intensity ratio of the orientation are values obtained, for example, by the ODF analysis method using "RINT2000 series application software" (three dimensional pole figure data processing program). The {111}<uvw> orientation is an orientation existing on the γ fiber at 54.7° of ϕ and at 45° of ϕ2 according to Bunge Type output.

Reduction of the |Δr| is sometimes achieved by performing cold rolling at a reduction rate of higher than 85% as the case of tin plate. However, such a high reduction rate is not preferable for the steel sheet for outer panels of automobile from the view points of cold rolling performance, cost, and quality. Therefore, the present invention is limited to a high strength cold rolled steel sheet that can be produced at a reduction rate of lower than 85%, or a high strength cold rolled steel sheet having a thickness of 0.4 mm or more, and therefore the tin plate is excluded from the present invention.

3. Compositions

The high strength cold rolled steel sheet of the present invention, for example, consists essentially of, by mass %, less than 0.05% C, 2.0% or less Si, 0.6 to 3.0% Mn, 0.08% or less P, 0.03% or less S, 0.01 to 0.1% Al, 0.01% or less N, and the balance of Fe.

C: C is an element required for improving strength of steel sheet, however, when the C content is 0.05% or more, stretchability is significantly deteriorated, in addition, it is not preferable from the viewpoint of weldability. Accordingly, the C content is made to be less than 0.05%. To form second phase having the above volume fraction, the C content is preferably 0.005% or more, and further preferably 0.007% or more.

Si: When Si content exceeds 2.0%, surface appearance is deteriorated, and plating adherence is significantly deteriorated. Accordingly, the Si content is made to be 2.0% or less, preferably 1.0% or less, and further preferably 0.6% or less.

Mn: Mn is generally effective for preventing cracking of steel slab in hot working by precipitating S in steel sheet as MnS. Moreover, in the present invention, Mn of 0.6% or more needs to be added to stably form second phases. However, when the Mn content exceeds 3.0%, cost of slab significantly increases, besides formability of steel sheet is deteriorated. Accordingly, the Mn content is made to be 0.6 to 3.0%, and preferably not less than 0.8% to less than 2.5%.

P: When P content exceeds 0.08%, the anti-secondary working embrittlement is deteriorated, or alloying property of zinc plating is deteriorated. Accordingly, the P content is made to be 0.08% or less, and preferably 0.06% or less.

S: S is a harmful element that deteriorates hot working performance of steel and increases sensibility to cracking of steel slab in hot working. Moreover, when the S content exceeds 0.03%, S is precipitated as fine MnS, resulting in deterioration in formability of steel sheet. Accordingly, the S content is made to be 0.03% or less, preferably 0.02% or less, and further preferably 0.015% or less. From the viewpoint of surface appearance, the S content is preferably 0.001% or more, and further preferably 0.002% or more.

Al: Al contributes to deoxidization of steel, and precipitates unnecessary solid solution N in steel as AlN. The effect is insufficient when Al is less than 0.01%, and saturates when Al exceeds 0.1%. Accordingly, the Al content is made to be 0.01 to 0.1%.

N: It is not preferable from the viewpoint of anti-aging that solid solution N exists in steel, therefore the N content should be preferably few. When the N content exceeds 0.01%, ductility or toughness is deteriorated because of existence of excessive nitrides. Accordingly, the N content is made to be 0.01% or less, preferably 0.007% or less, and further preferably 0.005% or less.

In addition to these elements, at least one element selected from 1% or less Cr, 1% or less Mo, 1% or less V, 0.01% or less B, 0.1% or less Ti, and 0.1% or less Nb is effectively added from the following reasons respectively.

Cr, Mo: Cr and Mo are effective elements for improving hardenability and forming second phases stably. Moreover, they are also effective for suppressing softening of heat affected zone (HAZ) formed at welding. To this end, at least one of Cr and Mo of 0.005% or more is preferably added, and further preferably 0.01% or more. However, when the content of each element exceeds 1%, the HAZ is excessively hardened, therefore each of the contents of Cr and Mo is made to be 1% or less, preferably 0.8% or less, and further preferably 0.6% or less.

V: V is effective for suppressing softening of HAZ formed at welding. To this end, V is preferably added 0.005% or more, and further preferably 0.007% or more. However, when the V content exceeds 1%, the HAZ is excessively hardened, therefore the V content is made to be 1% or less, preferably 0.5% or less, and further preferably 0.3% or less.

B: B is an effective element for improving hardenability and forming second phases stably. To this end, B is preferably added 0.0002% or more, and further preferably 0.0003% or more. However, when the B content exceeds 0.01%, the effects are saturated, therefore the B content is made to be 0.01% or less, preferably 0.005% or less, and further preferably 0.003% or less.

Ti, Nb: Ti and Nb act to form nitrides and reduce unnecessary solid solution N in steel. Improvement of formability of steel sheet can be expected by reducing solid solution N with Ti or Nb instead of Al. To this end, at least one of Ti and Nb is preferably added 0.005% or more, and further preferable 0.008% or less. However, when each of the contents exceeds 0.1%, the effects are saturated, therefore each of the contents of Ti and Nb is made to be 0.1% or less, and preferably 0.08% or less. However, when Ti or Nb is added in excess of the amount required for reducing solid solution N, carbides of excessive Ti or Nb are formed, which prevents the stable formation of second phases, therefore it is not preferable.

4. Manufacturing Conditions

The high strength cold rolled steel sheet of the present invention can be manufactured by cold rolling a hot rolled steel sheet having the above composition and second phases of 60% or more by volume fraction at a reduction rate of higher than 60% to lower than 85%, and then continuously annealing the cold rolled steel sheet in an $\alpha+\gamma$ region. To form second phases more stably after annealing, the annealing temperature needs to be set in a range from Ac1 transformation point to (Ac1 transformation point+80° C.), and preferably Ac1 transformation point to (Ac1 transformation point+50° C.).

As described above, to realize (1) uniformly dispersing second phases comprising mainly martensite phases in fine ferrite phases and (2) reducing an absolute value $|\Delta r|$ of in-plane anisotropy of r value, which are requirements for obtaining a cold rolled steel sheet having excellent stretchability, dent resistance, surface precision, anti-secondary working embrittlement, anti-aging, and surface appearance together, it is necessary that a hot rolled steel sheet before cold rolling contains second phases of 60% or more by volume fraction, preferably 70% or more, and further preferably 80% or more.

The mechanism is not completely clear, but considered as follows.

That is, in the case of the conventional hot rolled steel sheet comprising ferrite phases and pearlite phases, insufficiently dissolved carbides are apt to be present during annealing in an $\alpha+\gamma$ region, and coarse $\gamma$ phases are present ununiformly and sparsely reflecting the distribution of the pearlite phases in a hot rolled steel sheet. As a result, a structure comprising coarse ferrite phases and comparatively coarse second phases that are ununiformly dispersed is formed.

On the other hand, in the case of a hot rolled steel sheet having second phases of 60% or more by volume fraction as the present invention, fine carbides are once dissolved in ferrite phases during heating process in annealing, and then fine $\gamma$ phases are generated uniformly and densely from grain boundaries of ferrite phases during soaking in an $\alpha+\gamma$ region. As a result, the ferrite phases become uniform and fine, and the second phases are also dispersed finely and uniformly. In the case of the hot rolled steel sheet containing second phases as the present invention, a transformation texture is formed unlike the case of a conventional dual phase steel sheet comprising ferrite phases and pearlite phases, which gives the apparently same effect as the strain addition in cold rolling, and the $|\Delta r|$ can be reduced even at a typical reduction rate of 60 to 85% as described later.

Here, the second phases in the hot rolled steel sheet are acicular ferrite phases, bainitic ferrite phases, bainite phases, martensite phases, or mixture phases of them.

Figure 4:
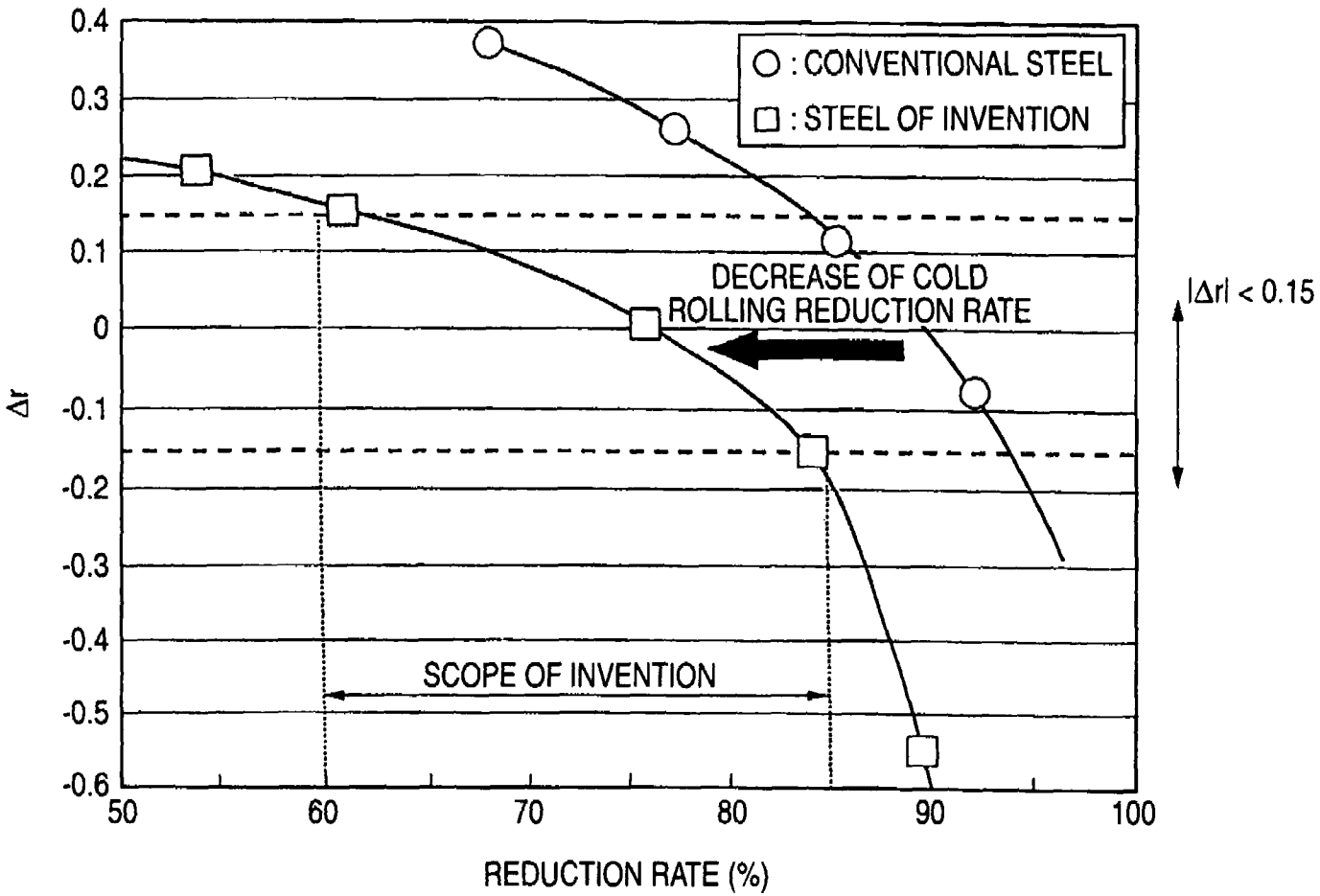
FIG. 4 is a relationship between reduction rate of cold rolling and $\Delta r$ after annealing.

FIG. 4 shows a relationship between reduction rate of cold rolling and $|\Delta r|$ after annealing, wherein such a hot rolled steel sheet having second phases is cold rolled at various reduction rates, and then continuously annealed in an $\alpha+\gamma$ region.

When the reduction rate of cold rolling is higher than 60% to lower than 85%, the $|\Delta r|$ of less than 0.15 can be obtained.

Figure 5:
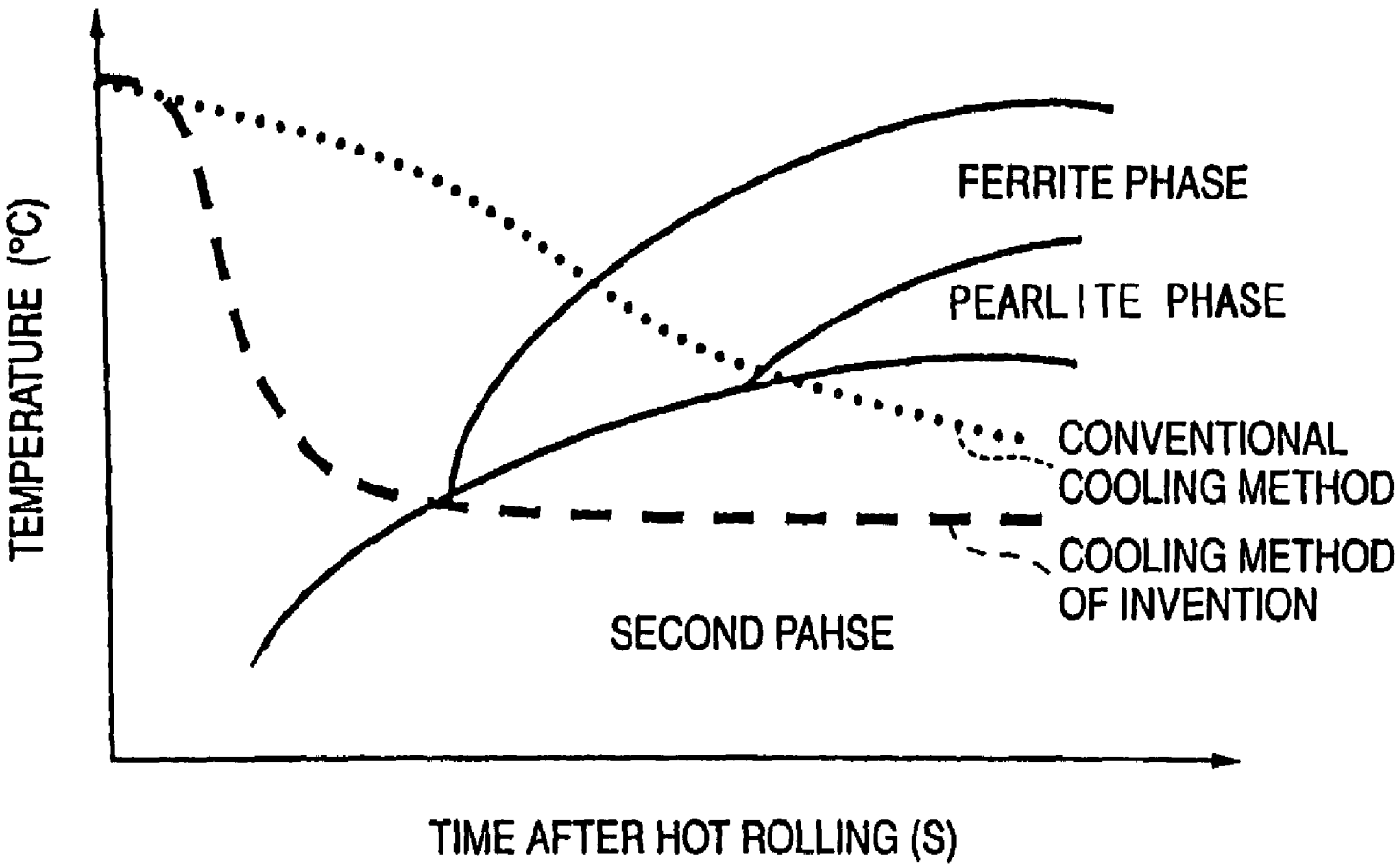
FIG. 5 is a continuous cooling transformation diagram for illustrating structure formation of hot rolled steel sheet according to the present invention.

To manufacture a hot rolled steel sheet having second phases of 60% or more by volume fraction, it is necessary, for example, that a steel slab having composition within the scope of the present invention as described above is hot rolled at Ar3 transformation point or higher, and then cooled within two seconds after hot rolling and over a temperature range of 100° C. or more at a cooling rate of 70° C./s or higher. The rapid cooling allows to suppress formation of ferrite phases as shown in the continuous cooling transformation diagram of FIG. 5. The time to start cooling after hot rolling is preferably within 1.5 sec, and further preferably within 1.2 sec.

Figure 6:
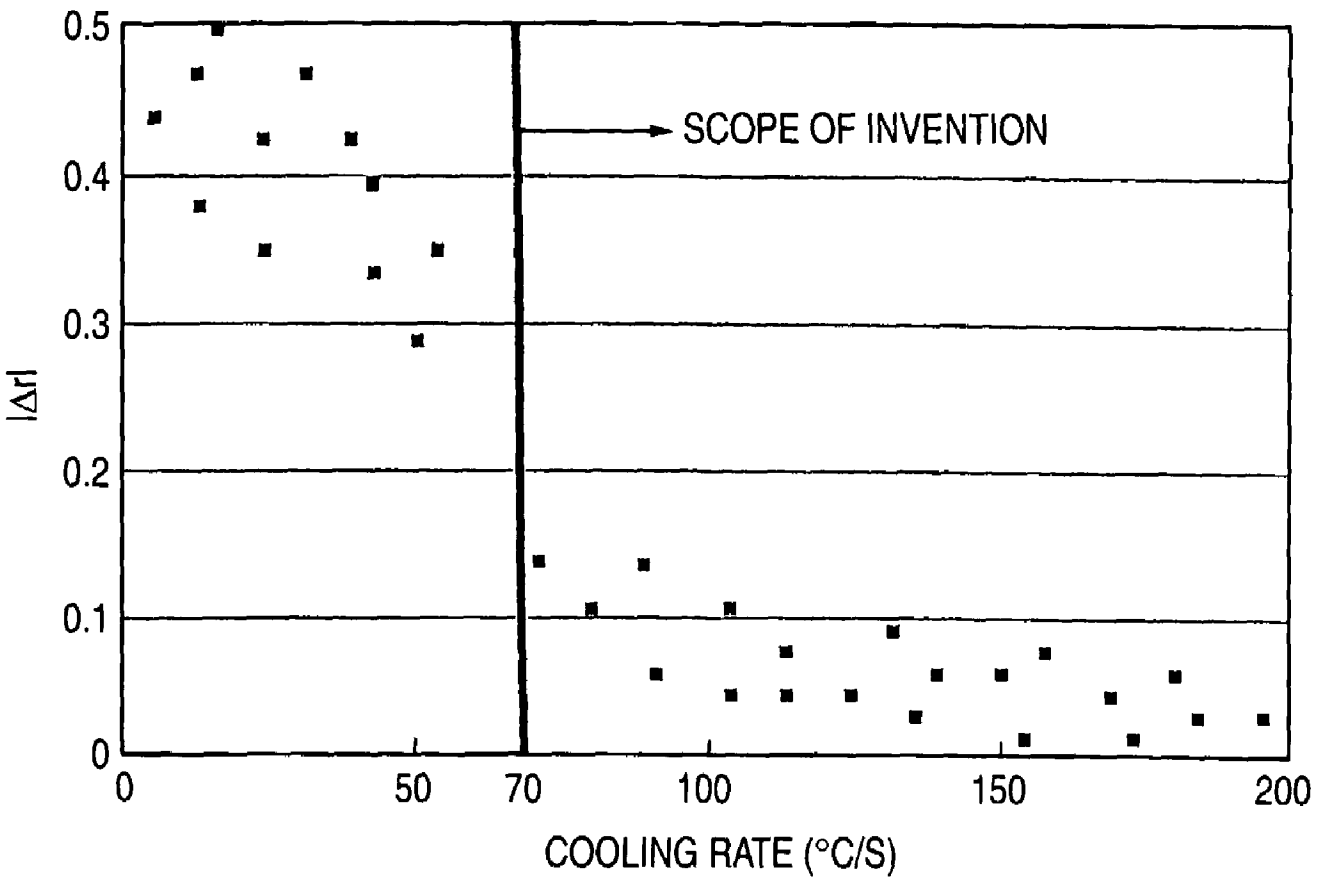
FIG. 6 is a relationship between cooling rate after hot rolling and $|\Delta r|$ after annealing.

FIG. 6 shows a relationship between cooling rate after hot rolling and $|\Delta r|$ after annealing. In this case, cooling temperature range $\Delta T$ is set to be 150° C.

When the cooling rate is 70° C./s or higher, the $|\Delta r|$ is less than 0.15. It is more effective that the cooling rate is higher than 100° C./s, and preferably higher than 130° C./s.

Figure 7:
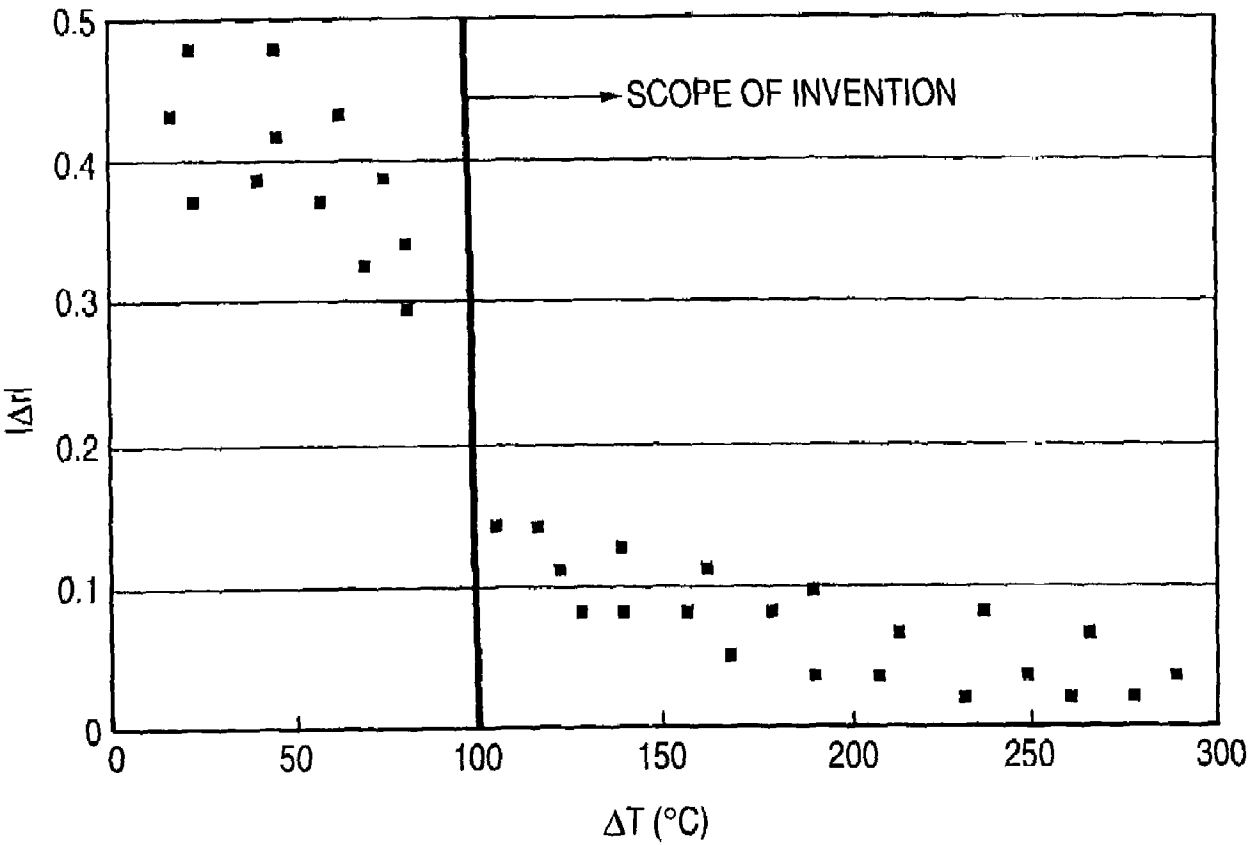
FIG. 7 is a relationship between cooling temperature range $\Delta T$ after hot rolling and $|\Delta r|$ after annealing.

FIG. 7 shows a relationship between cooling temperature range $\Delta T$ after hot rolling and $|\Delta r|$ after annealing. In this case, the cooling rate is set to be 150° C./sec.

When the cooling temperature range $\Delta T$ is 100° C. or more, the $|\Delta r|$ is less than 0.15. The cooling temperature range $\Delta T$ is preferably 130° C. or more, and more preferably 160° C. or more.

Figure 8:
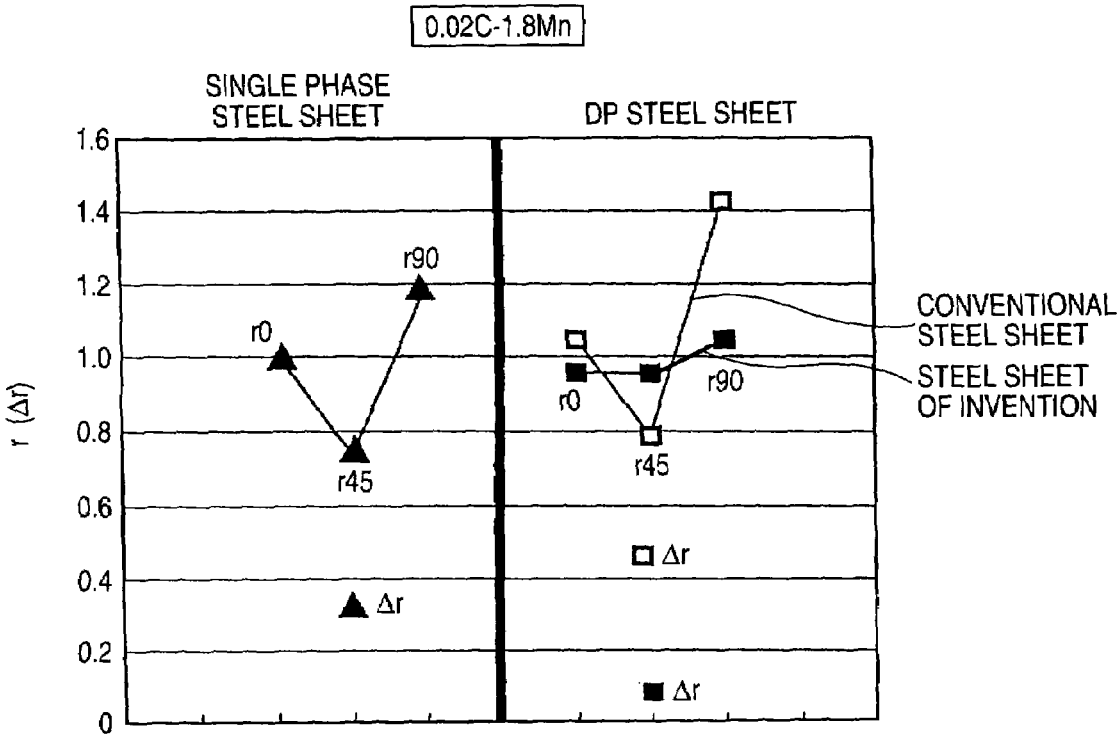
FIG. 8 is a relationship between cooling conditions after hot rolling and annealing conditions and $\Delta r$.

FIG. 8 shows a relationship between cooling conditions after hot rolling and annealing conditions and $\Delta r$.

When the continuous annealing is not performed in an $\alpha+\gamma$ region even if the hot rolling conditions as those in the present invention are employed, or when the continuous annealing is performed in an $\alpha+\gamma$ region without employing the hot rolling conditions as those in the present invention, the $\Delta r$ value is large. The small $\Delta r$ can be obtained at a normal reduction rate of cold rolling only when the hot rolling under the conditions of the present invention is combined with the continuous annealing in an α+γ region. This is the point of the present invention.

In a manufacturing method according to the present invention, a slab may be hot rolled after being reheated in a furnace, or directly hot rolled without being reheated. The coiling after hot rolling may be conducted at a temperature at which second phases of 60% or more by volume fraction can be formed, and under the cooling conditions after hot rolling of the present invention, normal coiling temperature can be applicable.

The continuous annealing can be performed in a present continuous annealing line or a present galvanization line.

The high strength cold rolled steel sheet of the present invention may be subjected to electrolytic galvanization or hot-dip galvanization. Alloying treatment may be applicable after galvanization. Furthermore, coating may be performed after galvanization.

EXAMPLE

Steels No. 1 to 15 as shown in Table 1 were melted, and then cast into slabs by continuous casting.

Steels No. 1 to 11 have composition within the scope of the present invention. On the other hand, Steels No. 12 to 15 have any one of C content, Si content, and Mn content without the scope of the present invention. Steels No. 1 to 11 of the present invention have an Ar3 transformation point of 820° C. or higher, and an Ac1 transformation point and an Ac3 transformation point between 740° C. and 850° C.

The slabs were reheated to 1200° C., hot rolled at finishing temperatures shown in Table 2, cooled under the conditions of cooling start time, cooling rate, and cooling temperature range ΔT shown in Table 2, and then coiled at normal coiling temperatures, thereby hot rolled steel sheets were produced. The hot rolled steel sheets were pickled, cold rolled into 0.75 mm in thickness at reduction rates shown in Table 2, and then subjected to continuous annealing in a continuous annealing line (CAL) or a continuous galvanizing line (CGL), thereby cold rolled steel sheets No. 1 to 30 having different tensile strength levels of 400 MPa or less, more than 400 MPa to not more than 500 MPa, and more than 500 MPa were produced. The annealing was carried out at soaking temperatures shown in Table 2. Some of the cold rolled steel sheets were subjected to galvanizing in an electrolytic galvanizing line (EGL). These cold rolled steel sheets were finally subjected to temper rolling at a reduction rate of 0.2 to 1.5%.

Microstructures of the hot rolled steel sheet and the cold rolled steel sheet were observed using a scanning electron microscope, and the grain size of ferrite phases, the volume fraction of second phases, the mean distance among second phases were obtained through image analysis. JIS No. 5 tensile test piece was used to measure r value and Δr. Furthermore, tensile test was carried out using the JIS 5 tensile test piece to obtain tensile strength TS and elongation El in a direction perpendicular to the rolling direction. To evaluate stretchability, test piece 200 mm by 200 mm was stretch formed using a hemispherical punch of 150 mm in diameter, thereby the limit of stretch height was measured.

The results are shown in Tables 3-1, 3-2, and 3-3.

Steels No. 1 to 5, 10, 15, 16, 18, 20, 22, 23, and 25 to 28 in which composition, grain size of ferrite phases, volume fraction of second phases, and |Δr| are all within the scope of the present invention have a high limit of stretch height and excellent stretchability compared with the comparative examples in which those conditions are not within the scope of the present invention, when the comparison is made in the same strength level.

Steel No. 7 as a comparative example, which is manufactured under the same conditions as those of the examples in JP-A-2001-207237 or JP-A-2002-322537, does not have a sufficiently high limit of stretch height although the volume fraction of second phases is within the scope of the invention. It seems to be because cooling conditions after hot rolling are without the scope of the present invention, resulting in a large Δr.

TABLE 1

(mass %)

| Steel No. | C | Si | Mn | P | S | Al | N | others | remarks |
|---|---|---|---|---|---|---|---|---|---|
| 1 | 0.007 | 0.02 | 2.05 | 0.031 | 0.016 | 0.071 | 0.0022 | Cr = 0.62 | Steel of the invention |
| 2 | 0.012 | 0.26 | 1.54 | 0.026 | 0.0009 | 0.015 | 0.0008 | Mo = 0.26, Ti = 0.031 | Steel of the invention |
| 3 | 0.015 | 0.02 | 1.50 | 0.020 | 0.005 | 0.050 | 0.0040 | Cr = 0.5 | Steel of the invention |
| 4 | 0.018 | 0.01 | 1.85 | 0.005 | 0.007 | 0.028 | 0.0016 | — | Steel of the invention |
| 5 | 0.023 | 0.68 | 2.48 | 0.035 | 0.010 | 0.049 | 0.0019 | Cr = 0.15, Mo = 0.08, V = 0.04 | Steel of the invention |
| 6 | 0.028 | 0.02 | 1.65 | 0.012 | 0.012 | 0.039 | 0.0049 | V = 0.35, Cr = 0.19 | Steel of the invention |
| 7 | 0.031 | 0.02 | 1.20 | 0.055 | 0.005 | 0.045 | 0.0029 | B = 0.0008, Nb = 0.033 | Steel of the invention |
| 8 | 0.035 | 1.20 | 1.15 | 0.068 | 0.009 | 0.029 | 0.0039 | — | Steel of the invention |
| 9 | 0.042 | 0.31 | 1.90 | 0.014 | 0.026 | 0.044 | 0.0035 | V = 0.08 | Steel of the invention |
| 10 | 0.046 | 0.55 | 0.88 | 0.008 | 0.011 | 0.048 | 0.0061 | Mo = 0.66 | Steel of the invention |
| 11 | 0.049 | 0.22 | 1.40 | 0.025 | 0.0006 | 0.031 | 0.0014 | B = 0.0038 V = 0.05 | Steel of the invention |
| 12 | 0.061 | 0.04 | 1.35 | 0.025 | 0.006 | 0.049 | 0.0049 | — | Comparative steel |

TABLE 1-continued

| Steel No. | C | Si | Mn | P | S | Al | N | others | remarks |
|---|---|---|---|---|---|---|---|---|---|
| | (mass %) | | | | | | | | |
| 13 | 0.027 | 2.1 | 1.54 | 0.035 | 0.019 | 0.039 | 0.0042 | — | Comparative steel |
| 14 | 0.046 | 0.21 | 3.15 | 0.011 | 0.028 | 0.055 | 0.0034 | — | Comparative steel |
| 15 | 0.003 | 0.03 | 0.59 | 0.04 | 0.009 | 0.044 | 0.0022 | — | Comparative steel |

TABLE 2

| Steel sheet No. | Steel No. | Finishing temperature (° C.) | Cooling start time (sec) | Cooling rate (° C./sec) | Cooling temperature range ΔT (° C.) | Reduction rate (%) | Annealing temperature (° C.) |
|---|---|---|---|---|---|---|---|
| 1 | 1 | 875 | 0.2 | 250 | 255 | 83 | 775 |
| 2 | 1 | 880 | 0.4 | 195 | 235 | 88 | 770 |
| 3 | 2 | 880 | 0.2 | 245 | 250 | 80 | 765 |
| 4 | 2 | 885 | 0.5 | 250 | 155 | 80 | 770 |
| 5 | 2 | 890 | 0.3 | 235 | 125 | 80 | 775 |
| 6 | 2 | 815 | 0.8 | 120 | 175 | 80 | 785 |
| 7 | 3 | 850 | 2.1 | 35 | 205 | 60 | 800 |
| 8 | 3 | 855 | 0.6 | 155 | 255 | 55 | 800 |
| 9 | 15 | 890 | 0.7 | 165 | 245 | 77 | 825 |
| 10 | 4 | 870 | 0.5 | 205 | 265 | 75 | 770 |
| 11 | 4 | 865 | 2.3 | 210 | 225 | 75 | 775 |
| 12 | 4 | 875 | 0.8 | 55 | 200 | 75 | 765 |
| 13 | 4 | 870 | 0.9 | 80 | 85 | 75 | 770 |
| 14 | 4 | 880 | 1.8 | 35 | 230 | 88 | 775 |
| 15 | 5 | 910 | 0.2 | 195 | 230 | 75 | 745 |
| 16 | 5 | 895 | 0.7 | 105 | 220 | 75 | 760 |
| 17 | 6 | 890 | 1.1 | 165 | 190 | 77 | 730 |
| 18 | 6 | 885 | 0.9 | 175 | 200 | 77 | 780 |
| 19 | 6 | 895 | 1.0 | 180 | 195 | 77 | 880 |
| 20 | 7 | 875 | 0.3 | 275 | 115 | 71 | 785 |
| 21 | 13 | 875 | 1.3 | 90 | 145 | 73 | 825 |
| 22 | 8 | 870 | 0.5 | 305 | 135 | 69 | 815 |
| 23 | 9 | 860 | 1.3 | 135 | 225 | 66 | 775 |
| 24 | 9 | 870 | 1.5 | 115 | 210 | 88 | 780 |
| 25 | 9 | 865 | 1.4 | 120 | 230 | 73 | 765 |
| 26 | 9 | 885 | 1.7 | 130 | 205 | 73 | 840 |
| 27 | 10 | 855 | 0.3 | 85 | 250 | 71 | 760 |
| 28 | 11 | 850 | 0.4 | 95 | 270 | 63 | 780 |
| 29 | 14 | 870 | 1.6 | 125 | 135 | 75 | 820 |
| 30 | 12 | 855 | 0.7 | 125 | 185 | 71 | 780 |

TABLE 3-1

| Steel sheet No. | Volume fraction of second phases after hot rolling (%) | Grain size d of ferrite phases (μm) | Volume fraction of second phases (%) | Mean distance L among second phases (μm) | 3.5 × d | Δr | $r_{max} - r_{min}$ | r90 | TS (MPa) | EI (%) | Limiting stretching height (mm) | remarks |
|---|---|---|---|---|---|---|---|---|---|---|---|---|
| 1 | 93 | 14.4 | 0.5 | 18.5 | 50.4 | 0.06 | 0.16 | 1.09 | 374 | 44.0 | 60.1 | Example of the invention |
| 2 | 83 | 15.9 | 0.4 | 32.1 | 55.7 | −0.01 | 0.13 | 1.37 | 364 | 39.7 | 58.0 | Example of the invention |
| 3 | 100 | 10.8 | 1.4 | 11.5 | 37.8 | 0.04 | 0.09 | 1.06 | 391 | 42.7 | 59.2 | Example of the invention |
| 4 | 77 | 11.4 | 1.2 | 20.4 | 39.9 | 0.11 | 0.14 | 1.08 | 382 | 42.9 | 58.7 | Example of the invention |
| 5 | 62 | 13.3 | 0.9 | 28.2 | 46.8 | 0.14 | 0.19 | 1.12 | 371 | 43.2 | 58.2 | Example of the invention |
| 6 | 0 | 15.9 | 0.9 | 56.4 | 55.7 | 0.48 | 0.63 | 1.41 | 377 | 38.6 | 54.8 | Comparative example |
| 7 | 0 | 14.2 | 3.1 | 52.2 | 49.7 | 0.34 | 0.50 | 1.38 | 385 | 37.6 | 53.4 | Comparative example |

TABLE 3-1-continued

| Steel sheet No. | Volume fraction of second phases after hot rolling (%) | Grain size d of ferrite phases (μm) | Volume fraction of second phases (%) | Mean distance L among second phases (μm) | 3.5 × d | Δr | $r_{max} - r_{min}$ | r90 | TS (MPa) | EI (%) | Limiting stretching height (mm) | remarks |
|---|---|---|---|---|---|---|---|---|---|---|---|---|
| 8 | 78 | 13.1 | 3.3 | 34.5 | 45.9 | 0.18 | 0.26 | 1.21 | 398 | 36.1 | 51.9 | Comparative example |
| 9 | 15 | 17.3 | 0 | — | — | 0.31 | 0.43 | 2.05 | 356 | 39.9 | 54.9 | Comparative example |
| 10 | 92 | 7.9 | 2.4 | 9.1 | 27.7 | 0.03 | 0.05 | 1.03 | 442 | 39.6 | 56.7 | Example of the invention |

TABLE 3-2

| Steel sheet No. | Volume fraction of second phases after hot rolling (%) | Grain size d of ferrite phases (μm) | Volume fraction of second phases (%) | Mean distance L among second phases (μm) | 3.5 × d | Δr | $r_{max} - r_{min}$ | r90 | TS (MPa) | EI (%) | Limit of stretch height (mm) | remarks |
|---|---|---|---|---|---|---|---|---|---|---|---|---|
| 11 | 25 | 10.4 | 1.6 | 25.0 | 36.4 | 0.37 | 0.55 | 1.37 | 412 | 36.5 | 52.9 | Comparative example |
| 12 | 10 | 9.2 | 1.3 | 28.6 | 32.2 | 0.54 | 0.68 | 1.43 | 422 | 35.9 | 51.7 | Comparative example |
| 13 | 0 | 9.7 | 1.5 | 35.1 | 34.0 | 0.42 | 0.58 | 1.39 | 417 | 36.1 | 51.4 | Comparative example |
| 14 | 0 | 11.3 | 1.8 | 40.3 | 39.6 | −0.46 | 0.49 | 0.69 | 409 | 37.4 | 52.3 | Comparative example |
| 15 | 95 | 6.7 | 2.6 | 7.9 | 23.5 | 0.06 | 0.09 | 1.05 | 460 | 38.4 | 55.7 | Example of the invention |
| 16 | 68 | 7.6 | 1.9 | 23.5 | 26.6 | 0.09 | 0.12 | 1.07 | 449 | 38.6 | 54.7 | Example of the invention |
| 17 | 87 | 6.5 | 0 | — | — | 0.40 | 0.49 | 1.24 | 461 | 33.9 | 50.4 | Comparative example |
| 18 | 91 | 6.4 | 3.4 | 8.2 | 22.4 | 0.06 | 0.23 | 1.14 | 477 | 37.1 | 55.2 | Example of the invention |
| 19 | 88 | 8.5 | 1.1 | 16.5 | 29.8 | −0.43 | 0.45 | 0.93 | 465 | 32.7 | 49.5 | Comparative example |
| 20 | 69 | 6.5 | 4.1 | 9.3 | 22.8 | 0.09 | 0.22 | 1.15 | 489 | 36.4 | 54.1 | Example of the invention |

TABLE 3-3

| Steel sheet No. | Volume fraction of second phases after hot rolling (%) | Grain size d of ferrite phases (μm) | Volume fraction of second phases (%) | Mean distance L among second phases (μm) | 3.5 × d | Δr | $r_{max} - r_{min}$ | r90 | TS (MPa) | EI (%) | Limit of stretch height (mm) | remarks |
|---|---|---|---|---|---|---|---|---|---|---|---|---|
| 21 | 45 | 20.5 | 0.7 | 72.5 | 71.8 | 0.08 | 0.43 | 1.22 | 452 | 37.8 | 50.6 | Comparative example |
| 22 | 79 | 6.2 | 4.4 | 14.5 | 21.7 | 0.12 | 0.23 | 1.21 | 515 | 34.8 | 51.8 | Example of the invention |
| 23 | 91 | 5.9 | 6.1 | 6.8 | 20.7 | 0.14 | 0.18 | 1.14 | 548 | 34.2 | 51.7 | Example of the invention |
| 24 | 89 | 8.2 | 5.9 | 16.0 | 28.7 | −0.33 | 0.37 | 0.79 | 531 | 30.1 | 46.5 | Comparative example |
| 25 | 88 | 6.2 | 6.2 | 6.6 | 21.7 | 0.00 | 0.04 | 1.01 | 545 | 34.4 | 51.6 | Example of the invention |
| 26 | 90 | 7.4 | 4.9 | 21.5 | 25.9 | 0.09 | 0.23 | 1.25 | 522 | 34.3 | 51.0 | Example of the invention |
| 27 | 98 | 5.1 | 7.9 | 5.6 | 17.9 | 0.07 | 0.10 | 1.06 | 572 | 33.3 | 50.2 | Example of the invention |
| 28 | 100 | 4.1 | 9.8 | 5.5 | 14.4 | 0.14 | 0.18 | 1.14 | 590 | 32.4 | 49.5 | Example of the invention |
| 29 | 100 | 5.2 | 10.8 | 5.1 | 18.2 | 0.31 | 0.47 | 1.38 | 609 | 29.2 | 44 | Comparative example |

TABLE 3-3-continued

| Steel sheet No. | Volume fraction of second phases after hot rolling (%) | Grain size d of ferrite phases (μm) | Volume fraction of second phases (%) | Mean distance L among second phases (μm) | 3.5 × d | Δr | $r_{max} - r_{min}$ | r90 | TS (MPa) | EI (%) | Limit of stretch height (mm) | remarks |
|---|---|---|---|---|---|---|---|---|---|---|---|---|
| 30 | 91 | 4.8 | 14.3 | 4.3 | 16.8 | 0.48 | 0.66 | 1.45 | 645 | 28.3 | 42 | Comparative example |

The invention claimed is:

1. A high strength cold rolled steel sheet comprising ferrite phases and second phases, said steel sheet consisting essentially of, by mass %, 0.005 to 0.05% C, 2.0% or less Si, 0.6 to 3.0% Mn, 0.08% or less P, 0.03% or less S, 0.01 to 0.1% Al, 0.004% or less N to avoid the presence of solid solution N and to promote an anti-ageing property, optionally at least one element selected from the group consisting of 1% or less Cr, 1% or less Mo, 1% or less V, 0.01% or less B, 0.1% or less Ti, 0.1% or less Nb, and a balance of Fe, wherein the ferrite phases have a mean grain size of 20 μm or less, the second phases have a volume fraction of not less than 0.1% to less than 10%, the absolute value of the in-plane anisotropy of the r value |Δr| is less than 0.15, and the thickness of the steel sheet is 0.4 mm or more, wherein the mean distance L in μm among adjacent second phases measured along the grain boundaries of the ferrite phase satisfies the following formula (1) when the mean grain size of the ferrite phases is d in μm:

$$L < 3.5 \times d \quad (1).$$

2. The high strength cold rolled steel sheet according to claim 1, wherein the difference between maximum value $r_{max}$ and minimum value $r_{min}$ of the r values at 0° (r0), 45° (r45), and 90° (r90) to a rolling direction are each 0.25 or less.

3. The high strength cold rolled steel sheet according to claim 1, wherein the r value at 90° to a rolling direction, or r90, is 1.3 or less.

4. The high strength cold rolled steel sheet according to claim 1 further containing at least one element selected from the group consisting of 1% or less Cr, 1% or less Mo, 1% or less V, 0.01% or less B, 0.1% or less Ti, and 0.1% or less Nb.

5. The high strength cold rolled steel sheet according to claim 2 further containing at least one element selected from the group consisting of 1% or less Cr, 1% or less Mo, 1% or less V, 0.01% or less B, 0.1% or less Ti, and 0.1% or less Nb.

6. The high strength cold rolled steel sheet according to claim 3 further containing at least one element selected from the group consisting of 1% or less Cr, 1% or less Mo, 1% or less V, 0.01% or less B, 0.1% or less Ti, and 0.1% or less Nb.

7. A method for manufacturing a high strength cold rolled steel sheet comprising the steps of:

cold rolling a hot rolled steel sheet according to any one of claims 1, 2, 3, 4, 5 or 6, the hot rolled steel sheet containing second phases of 60% or more by volume fraction, at a reduction rate of higher than 60% to lower than 85%, and continuously annealing the cold rolled steel sheet in an α+γ region.

8. The method according to claim 7, wherein prior to the cold rolling, the hot rolled steel sheet is cooled within two seconds after being hot rolled at an Ar3 transformation temperature or higher, and over a temperature range of 100° C. or more at a cooling rate of 70° C./s or higher.

9. The high strength cold rolled steel sheet according to claim 1, wherein said steel sheet has a tensile strength of 370 to 590 MPa.

10. The high strength cold rolled steel sheet according to claim 1, wherein the mean grain size of the ferrite phases is 15 μm or less.

11. The high strength cold rolled steel sheet according to claim 1, wherein the mean grain size of the ferrite phases is 12 μm or less.

12. The high strength cold rolled steel sheet according to claim 1, wherein the volume fraction of the second phases is not less than 0.5% to less than 8%.

13. The high strength cold rolled steel sheet according to claim 1, wherein the second phases comprise mainly martensite phases.

14. The high strength cold rolled steel sheet according to claim 3, wherein the r90 is 1.25 or less.

15. The high strength cold rolled steel sheet according to claim 3, wherein the r90 is 1.2 or less.

16. The high strength cold rolled steel sheet according to claim 15, wherein the mean grain size of the ferrite phases is 12 μm or less; and the volume fraction of the second phases is not less than 0.5% to less than 8 %.

17. The method according to claim 7, wherein the hot rolled steel sheet before cold rolling contains 70 volume % or more of the second phases.

18. The method according to claim 7, wherein the hot rolled steel sheet before cold rolling contains 80 volume % or more of the second phases.

* * * * *